United States Patent [19]

Ganz et al.

[11] 4,336,543

[45] Jun. 22, 1982

[54] ELECTRONICALLY SCANNED AIRCRAFT ANTENNA SYSTEM HAVING A LINEAR ARRAY OF YAGI ELEMENTS

[75] Inventors: Frederick M. Ganz, Smithtown; Justine D. Cermignani, Fort Salonga; Richard H. Imgram, Plainview, all of N.Y.

[73] Assignee: Grumman Corporation, Bethpage, N.Y.

[21] Appl. No.: 142,772

[22] Filed: Apr. 22, 1980

Related U.S. Application Data

[63] Continuation of Ser. No. 798,085, May 18, 1977, abandoned, which is a continuation of Ser. No. 618,401, Oct. 1, 1975, abandoned.

[51] Int. Cl.[3] ..... H01Q 1/28; H01Q 21/08

[52] U.S. Cl. ..... 343/705; 343/815; 343/844; 343/854

[58] Field of Search ..... 343/815, 817, 818, 844, 343/853, 854, 879

[56] References Cited

U.S. PATENT DOCUMENTS

| | | | |
|---|---|---|---|
| 2,407,169 | 9/1946 | Loughren | 343/854 |
| 3,373,434 | 3/1968 | Lorenzo et al. | 343/879 |

*Primary Examiner*—Eli Lieberman

*Attorney, Agent, or Firm*—Morgan, Finnegan, Pine, Foley & Lee

[57] ABSTRACT

An electronically scanned antenna system having a linear array of endfire elements. The endfire elements are laterally spaced between about 0.3 λ to 0.9 λ apart, preferably about 0.55 λ apart, to enhance the effects of mutual coupling therebetween for broadening the radiation signal pattern of the elements in the plane of the array. Advantageously, the endfire elements may be of the Yagi type with each endfire element including a common reflector, a driver, and a plurality of directors.

15 Claims, 5 Drawing Figures

ELECTRONICALLY SCANNED AIRCRAFT ANTENNA SYSTEM HAVING A LINEAR ARRAY OF YAGI ELEMENTS

This is a continuation of application Ser. No. 798,085 filed May 18, 1977, now abandoned, which is in turn a continuation of application Ser. No. 618,401 filed Oct. 1, 1975 and now abandoned.

The present invention relates to antennas, and more particularly to an electronically scanned antenna system having a linear array of endfire elements. An endfire element is defined as an element whose maximum gain is obtained along the element axis.

Electronically scanned linear arrays of simple elements are well known. Such arrays are generally characterized by relatively low gain, and a broad elevation pattern. Arrays of endfire elements in which scanning is accomplished mechanically by rotating the entire array are also known. These arrays are unsatisfactory when conformal mounting in the plane of the array is required, e.g., on or within airfoil surfaces (wings and horizontal stabilizer) of an aircraft.

Various antenna element configurations are known. U.S. Pat. No. 2,236,393 (Beck et al.) discloses a broad bandwith endfire antenna. U.S. Pat. No. 3,182,330 (Blume) discloses an antenna array having non-uniform spacing of the individual elements. U.S. Pat. No. 2,425,887 (Lindenblad) discloses an endfire antenna in which all the elements are energized with equal voltages in proper phase. U.S. Pat. No. 3,258,774 (Kinsey) discloses a series-fed phased antenna array. See also U.S. Pat. No. 3,509,577 (Kinsey). U.S. Pat. No. 2,419,562 (Kandolan) discloses a binomial array for producing a clover leaf pattern having highly directive properties. A conventional Yagi antenna is referenced in U.S. Pat. No. 3,466,655 (Mayes et al.).

Moreover, generally in known antenna array constructions mutual coupling is regarded as detrimental and means are taken to minimize its effect. In contrast the present invention utilizes mutual coupling to enhance antenna performance.

Endfire elements are known to produce high density with narrow patterns in both planes (azimuth and elevation), and are therefore, according to conventional practice, considered unsuitable for wide angle electronic scanning when multiple elements are arrayed. (The scan angle limits being established by the width of the in-array element pattern.) In contrast with conventional practice, the present invention advantageously utilizes arrayed multiple elements for wide angle scanning by employing mutual coupling between the elements to broaden the endfire element pattern in the plane in which electronic scanning is desired.

It is an object of the present invention to provide an antenna array having a high gain and narrow elevation beam, with a narrow azimuthal beam which can be electronically scanned throughout a wide azimuthal sector.

It is a further object of the present invention to provide an antenna array of very small elevation so as to be suitable for installation on or within the airfoil surfaces of an aircraft, e.g., wing leading edges and the horizontal stabilizer trailing edge, usable with a suitable radome which is an integral part of the airfoil.

It is a still further object of the present invention to provide an antenna array having a high gain and broadened in-array element pattern for increasing the angle over which the antenna mainlobe can be electronically scanned.

It is a still further object of the present invention to broaden the narrow in-array element pattern of an endfire element array.

It is a still further object of the present invention to broaden the in-array pattern of an endfire element array in one plane only.

Other objects, aspects, and advantages of the present invention will be apparent when the detailed description is considered with the drawings.

Briefly, the present invention includes an electronically scanned antenna system having a linear array of endfire elements in which the endfire elements are laterally spaced between about 0.3λ to about 0.9λ apart, preferably about 0.55λ apart, to enhance the effects of the mutual coupling therebetween for broadening the radiation signal pattern in the plane of the array.

"Electronic scanning" as the term is used herein entails adjustments in the excitation coefficients (e.g., phase and amplitude) of the elements in the array in accordance with the direction in which the formation of a beam is desired.

It is well known to those skilled in the art that the beam of an antenna points in a direction that is normal to the phase front. In phased arrays the phase front is adjusted to steer the beam by individual control of the phase excitation of each radiating element. Phase shifters are electronically actuated to permit rapid scanning and are adjusted in phase to a value between 0 and $2\pi$ radians. While this method of electronic scanning is perhaps the most commonly used, other means may be employed to effect the same changes in the phase front of the array to produce steerage of the beam. Control of the excitation coefficients of the elements of the array is commonly known as "antenna feed", and includes all means for independently or dependently controlling the amplitude and phase of the signals to or from the individual elements of the antenna array, and dividing or combining means therefore.

The present invention is illustrated in the accompanying drawings, in which.

Figure 1:
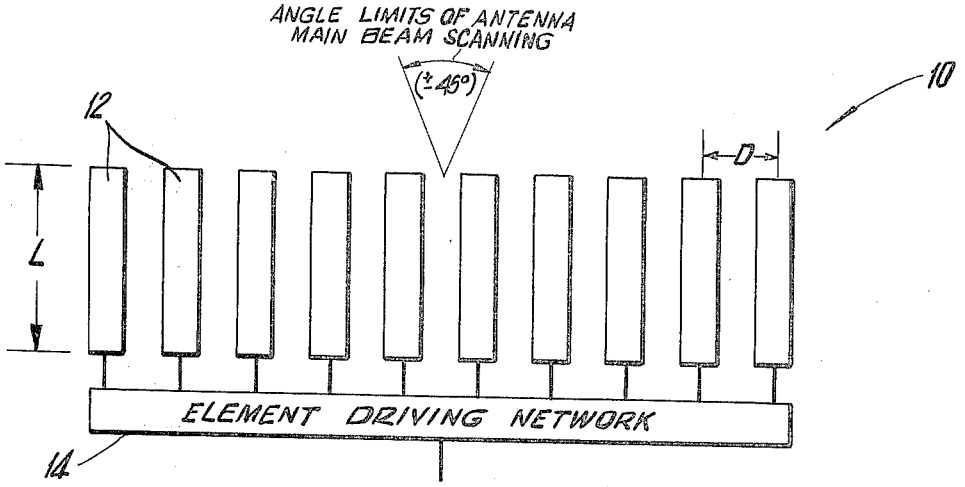
FIG. 1 is a top plan view of a linear array of endfire elements according to the present invention.

Referring to FIG. 1, an antenna according to the present invention is generally illustrated at 10. It should be understood that the antenna 10 may be used with acoustic as well as electromagnetic waves, although in the description the antenna will be described with reference to electromagnetic waves. The antenna 10 includes a linear array of endfire elements 12 electronically coupled to an element driving network 14 which is conventionally known as an antenna feed.

Each endfire element 12 is laterally spaced a distance (D) between about 0.3λ and about 0.9λ apart, preferably about 0.55λ apart (center-to-center) to enhance the effects of mutual coupling between the elements 12, resulting in a broadened element pattern of the main-beam in the plane of the array, see the dotted lines and arrows in FIG. 1. The length (L) of each individual element 12 is approximately 1.25λ.

Figure 2:
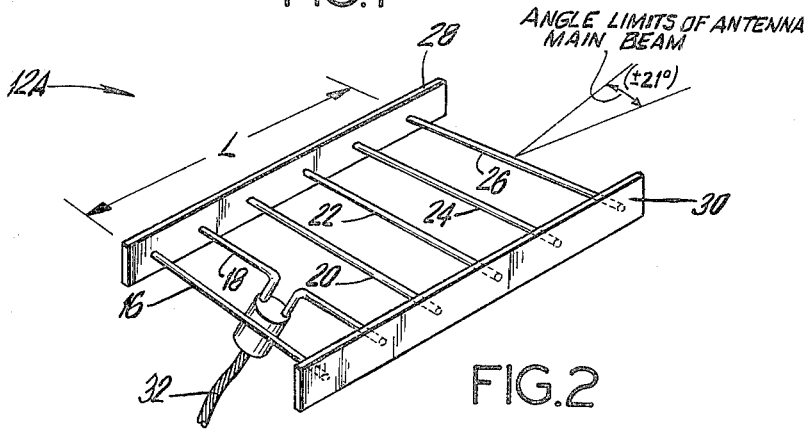
FIG. 2 is a perspective view of a Yagi endfire element for the linear array of the present invention.

Referring to FIG. 2, a Yagi endfire element 12A for use in the array of the present invention is shown. As is well known, a Yagi endfire array includes at least two parasitic elements in addition to the driven element. The Yagi endfire element 12A includes six conductive elements 16, 18, 20, 22, 24 and 26. Such a multiparasitic array is known as a 6-element beam. Each element has a diameter of approximately 0.01λ and a length of approximately 0.5λ.

The six elements 16, 18, 20, 22, 24 and 26 are positioned in spaced parallel relationship along the same line of sight (transverse axis) with the spacing between adjacent elements being approximately 0.25λ. The six elements 16, 18, 20, 22, 24, and 26 are supported on a pair of non-conductive Plexiglas supports 28 and 30, e.g., by inserting the elements 16, 18, 20, 22, 24, and 26 into mating holes in the Plexiglass support. The supports 28 and 30 electrically insulate the elements 16, 18, 20, 22, 24 and 26 from one another, and advantageously are substantially invisible to the resulting electromagnetic waves.

Element 16 is the reflector element, element 18 the driven element, and elements 20, 22, 24 and 26 the director elements. A coaxial cable 32 is electrically coupled to the driven element 18 for providing a signal thereto. The reflector 16 and directors 20–26 interact in a conventional manner to provide increased gain and unidirectivity to the radiated signal pattern. The free-space half-power beamwidths of element 12A is 42° in the E plane and 48° in the H plane.

Figure 3:
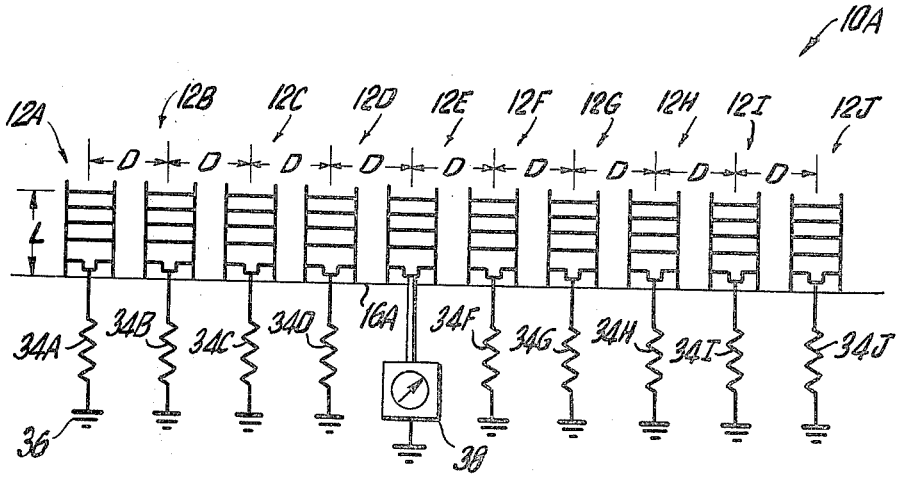
FIG. 3 is a top plan of a linear array of Yagi endfire elements of the type shown in FIG. 2 in which all the endfire elements have a common reflector.

Referring to FIG. 3, ten endfire elements 12A-J of the type shown in FIG. 2 are arranged in a linear array 10A. The endfire elements 12A-J have a common reflector 16A and are closely spaced laterally a distance of between about 0.3λ and about 0.9λ apart, preferably about 0.55λ apart (center-to-center), to increase the effects of mutual coupling therebetween. With such an arrangement, the in-array pattern, i.e., the angle over which the antenna mainlobe can be electronically scanned increases from 42° for the single endfire element 12A of FIG. 2, see the dotted lines and arrows of FIG. 2, to greater than 90° in the array 10A. The narrow H plane pattern of 48° for the single endfire element 12A is maintained in the array 10A. Thus, the effect of closely spacing the endfire elements 12A in the linear array 10 is to broaden the element pattern in the plane of the array 10A (E plane) while preserving the narrow H plane pattern.

THe broadened E-plane pattern of the in-array endfire element may be demonstrated as follows: The elements 12A–D and 12F–J have individual terminating impedances 34A–D and 34F–J coupled to ground 36 in the array 10A. The terminating impedances 34A–D and 34F–J are chosen to match the antenna driving point impedance to an antenna scan angle of 0° in the E-plane. In the embodiment illustrated in FIG. 3, the terminating impedances 34A–D and 34F–J are 50 ohms. Element 12E is monitored by meter 38 which measures the power received by element 12E when the array 10A is used as a receiving device to receive signals transmitted by a radiating device (not shown) positioned at sufficient distance from the array 10A so as to be in the far field of the array 10A. As the array 10A is rotated in angle with respect to the radiating device, the power measured in meter 38 will vary in proportion to the in-array element pattern of element 12E. This method of pattern measurement is well known in the art. Moreover, it is also well known in the art that the in-array element pattern measured in this manner is approximately proportional to the gain of the array 10A as a function of angle when the outputs of all of the elements 12A–J are utilized to form a beam.

Figure 4:
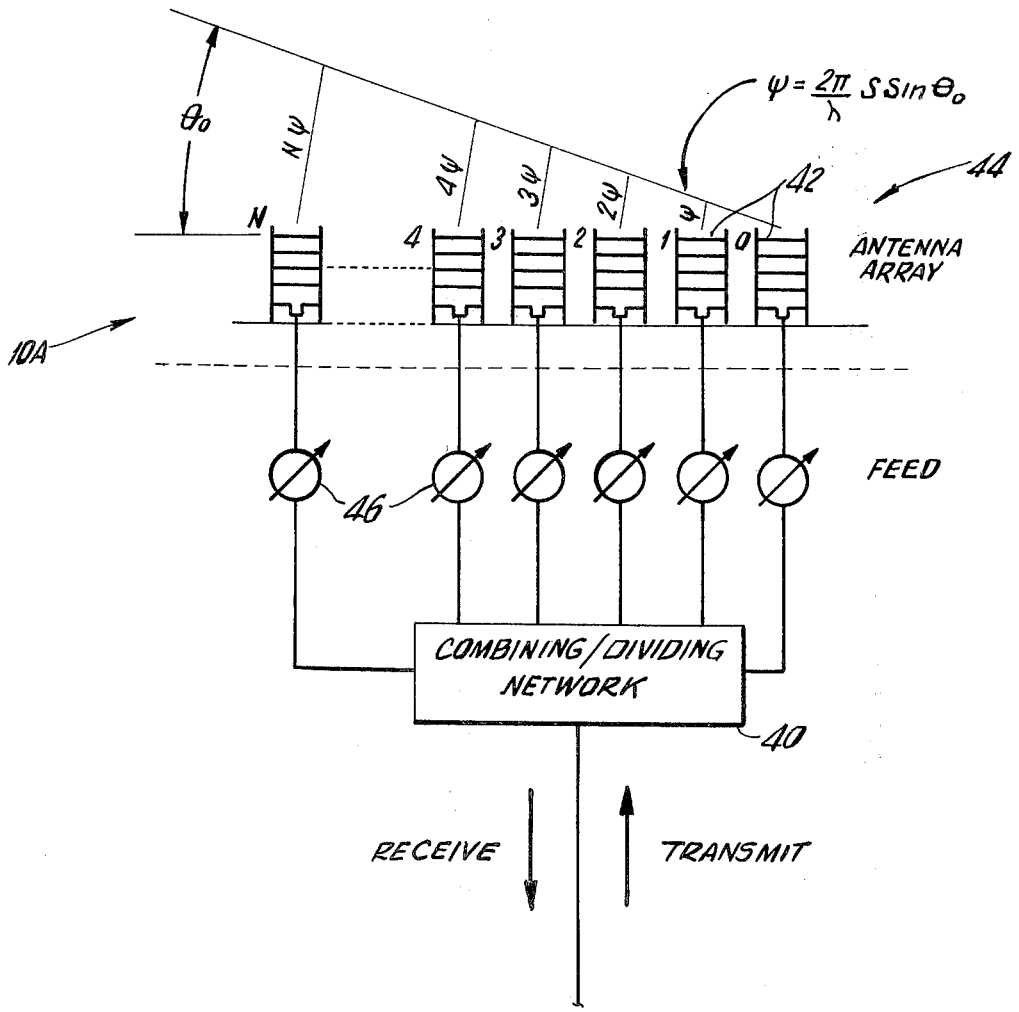
FIG. 4 is a top plan view of a linear array of endfire elements similar to FIG. 3 being scanned at an angle $\theta_o$.

With reference to FIG. 4, the array 10A operates as follows: A feed means (not shown) applies transmission signals to a combining/dividing network 40 which splits the signals for transmission by the individual elements 42 of the array 44 (N elements are shown). N phase shifters 46 shift the phase of the signals in accordance with the direction in which a beam is desired. In applications where unequal amplitudes are desired for each antenna element to provide lower antenna sidelobes (commonly known as amplitude taper), the combining/dividing network 48 advantageously provides such a distribution.

The antenna array 10A with its feed is linear passive and bilateral and is subject to the law of reciprocity so that when it is used in the receiving mode its characteristics are unaltered.

Figure 5:
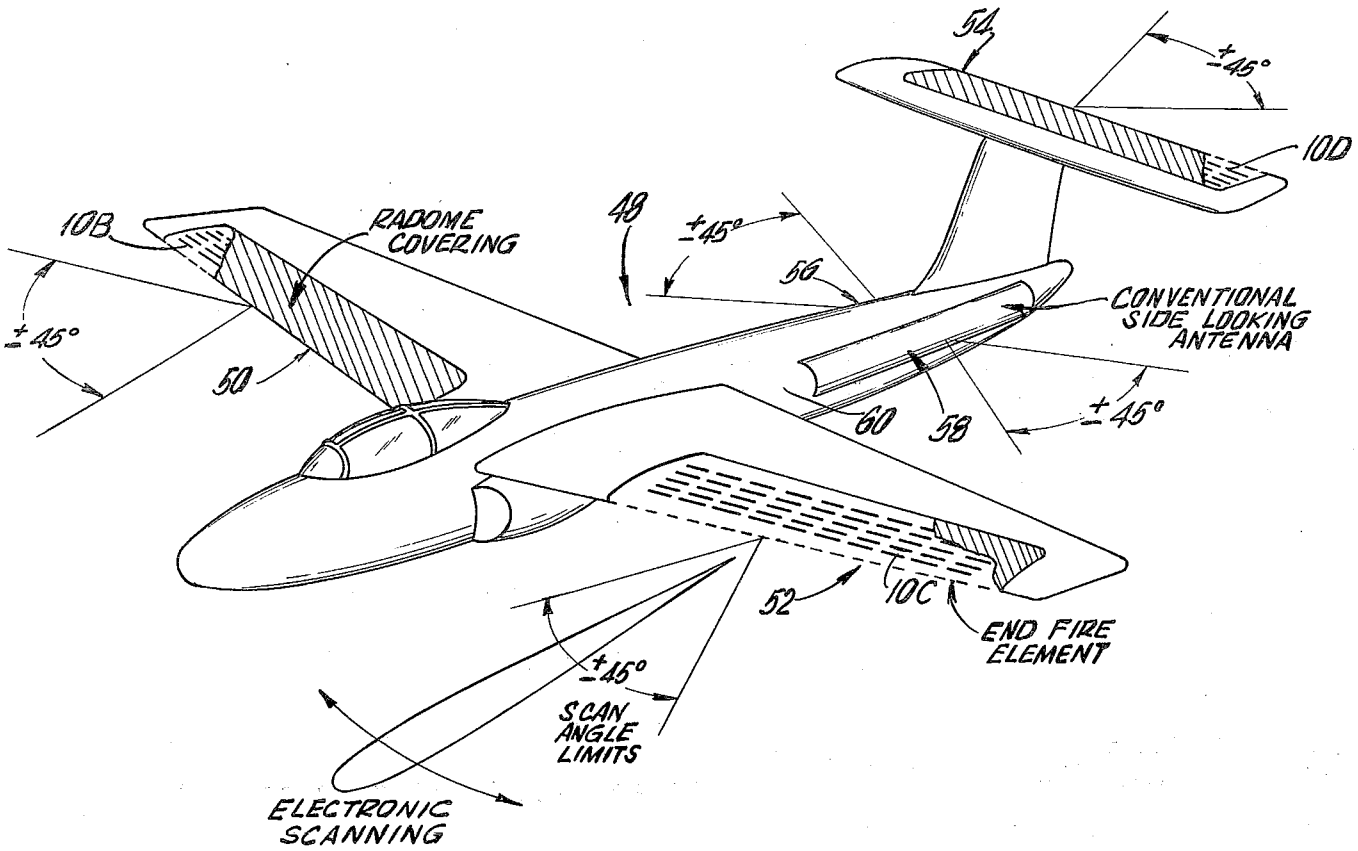
FIG. 5 is a perspective view of an aircraft with parts broken away to indicate the mounting thereon of linear arrays of endfire elements in accordance with the present invention.

Referring to FIG. 5, an aircraft 48 is illustrated with antenna arrays 10 B, C and D in accordance with the present invention positioned in the wing leading edges 50 and 52 and in the horizontal stabilizer 54. With this arrangement 360° azimuthal coverage is obtained by electronically scanning the arrays 10B–D and conventional side-looking antennas 56 and 58 mounted on opposite sides of the fuselage 60. Advantageously, such an arrangement avoids the need for a large dome mounted on the fuselage 60 which must be mechanically rotated to provide the same 360° azimuthal coverage.

It should be apparent to those skilled in the art that various modifications may be made in the present invention without departing from the spirit and scope thereof, as described in the specification and defined in the appended claims.

What is claimed is:

1. An antenna system for conformal mounting on an aircraft for generating an electronically scanned main radiation lobe comprising:

(a) a linear array of Yagi antennas which are laterally spaced from one another a distance of about 0.3λ to 0.9λ center to center, each of said Yagi antennas including a driven element, a reflector member and a director member, each of which having a length less than the spacing between each adjacent Yagi antenna, each of said Yagi antennas being operative to radiate:

i. free space beam widths Bx and By in the coordinate X and Y planes, respectively, the values of Bx and By being substantially less than 90°; and ii. free space maximum gain in the direction of the lengths of said Yagi antennas; and (b) means for scanning the antenna system main lobe in the X plane over an angle A substantially greater than Bx, while at the same time maintaining a system main lobe beam width in the Y plane which approximates By, said scan angle A being able to be broadened to greater than 90° as a result of enhanced mutual coupling between said Yagi antennas.

2. The antenna system of claim 1, wherein:

the spacing between said Yagi antennas is about 0.55λ.

3. The antenna system as claimed in claim 1, wherein: Bx is approximately 42°.

4. The antenna system of claim 1, wherein: the system main lobe beam width in the Y plane is about 48°.

5. The antenna system claimed in claim 1, wherein: said linear array includes ten Yagi antennas which are arrayed in the E-plane, each Yagi antenna further including three additional director members.

6. The system as defined in claim 1, further including means for conformally mounting said Yagi antennas in an aircraft wing.

7. The system as defined in claim 1, further including
(1) a pair of side-looking antennae;
(2) means for conformally mounting said sidelooking antennae and said electronically scanned antenna system in an aircraft whereby wide azimuthal coverage is obtained.

8. The system as defined in claim 7 wherein there are two of said electronically scanned antenna systems and wherein said mounting means include further means for mouting said two systems in a back-to-back relationship.

9. The system as defined in claim 7 in which said mounting means are adapted to conformally mount said electronically scanned antenna systems within the wing of said aircraft.

10. The system as defined in claim 8 in which said further means are adapted to conformally mount said two systems in the wing and horizontal stabilizer of said aircraft, respectively.

11. The system as defined in claim 10, wherein: said side-looking antenna are conformally mounted on an aircraft fuselage.

12. The antenna system of claim 1 wherein the reflector member of each of said Yagi antennas is a common reflector member.

13. The antenna system of claim 1 wherein each Yagi antenna has a length of approximately 1.25λ.

14. The antenna system of claim 1 wherein said Yagi antennas include non-conductive support means for fixedly positioning the driven element, reflector member, and driven member of each Yagi antenna relative to one another.

15. The antenna system of claim 1 in which said driven element, reflector member and director member of each Yagi antenna are spaced from one another a distance of about 0.25λ.

* * * * *